US010934643B1

(12) United States Patent
Dobek

(10) Patent No.: US 10,934,643 B1
(45) Date of Patent: Mar. 2, 2021

(54) BOW TYING TOOL

(71) Applicant: Rose Ann Dobek, Macomb Township, MI (US)

(72) Inventor: Rose Ann Dobek, Macomb Township, MI (US)

( * ) Notice: Subject to any disclaimer, the term of this patent is extended or adjusted under 35 U.S.C. 154(b) by 0 days.

(21) Appl. No.: 16/918,235

(22) Filed: Jul. 1, 2020

(51) Int. Cl.
*D04D 11/00* (2006.01)
*D04D 7/10* (2006.01)

(52) U.S. Cl.
CPC ..... *D04D 11/00* (2013.01); *D04D 7/10* (2013.01)

(58) Field of Classification Search
CPC ..... D04D 11/00; D04D 7/00–10; A41D 27/08
USPC ..... D11/130
See application file for complete search history.

(56) References Cited

U.S. PATENT DOCUMENTS 3,501,070 A 3/1970 Shattuck
3,816,888 A * 6/1974 Rather, Jr. ..... D04D 5/00 28/147
4,454,968 A * 6/1984 StLawrence ..... D04D 11/00 223/46
5,411,188 A 5/1995 Teuten
D396,950 S * 8/1998 Werling ..... D04D 7/10 D3/26
5,797,526 A 8/1998 Wells
5,810,214 A * 9/1998 Hecht ..... D04D 7/10 223/46
6,131,778 A * 10/2000 Etzion ..... D04D 7/10 223/46
8,403,145 B1 3/2013 Yip et al.
D741,592 S 10/2015 Shainwald et al.
2008/0038489 A1 2/2008 Lodge et al.
2009/0294490 A1* 12/2009 Gustin ..... D04D 7/10 223/46
2010/0047604 A1 2/2010 Stratton-Metzger
2015/0050433 A1 2/2015 Murray

* cited by examiner

*Primary Examiner* — Ismael Izaguirre
(74) *Attorney, Agent, or Firm* — Cramer Patent & Design, PLLC; Aaron R. Cramer

(57) ABSTRACT

A bow tying tool includes a base having a pair of vertical sliding ribbon clips and a pair of horizontally disposed ribbon clips which are secured adjacent each other on the base. A ribbon retention knob is perpendicularly secured to an edge of the base opposite the horizontally disposed ribbon clips.

16 Claims, 7 Drawing Sheets

BOW TYING TOOL

RELATED APPLICATIONS

None.

FIELD OF THE INVENTION

The presently disclosed subject matter is directed to a tying tool and more specifically to a bow tying tool.

BACKGROUND OF THE INVENTION

Whether at Christmas time or a during a birthday party, nothing accentuates a present like a ribbon bow. However, in these hectic times, most people skip placing a bow on a gift entirely. For those individuals who desire to dress the package up with a bow regardless of the inconvenience—such bows are usually purchased in bulk at a supermarket or online.

For a certain small section of the gift giving population tying a bow by hand is the only way to go. However, getting a perfect bow each and every time requires patience and practice. Therefore, the need exists for a tool whereby a user may easily and efficiently tie a perfect bow made of ribbon. The bow tying tool accomplishes this task.

SUMMARY OF THE INVENTION

The principles of the present invention provide for a bow tying device which comprises a front, a back, a top, a bottom, a left side, a right side, an upper work surface coupled to an upper left tying support, an upper right tying support, a left fastener, and a right fastener and a lower work surface having a lower left tying support, a lower right tying support and a main port along the bottom. The left fastener and the right fastener may manipulate a ribbon around the upper left tying support, the upper right tying support, the lower left tying support and the lower right tying support.

The left fastener and the right fastener may be coupled to the upper work surface. The upper work surface and the lower work surface may conceal an inner cavity which may be used to store a plurality of associated contents within the bow tying device. The upper left tying support and the upper right tying support of the upper work surface, and the lower left tying support and the lower right tying support of the lower work surface each may be a general rectangular prism. The general rectangular prisms each have a plurality of rounded upper corners. The lower left tying support and the lower right tying support may be identical in shape. The upper work surface is smaller in overall volume than the lower work surface.

The left fastener and the right fastener may be on the top of the bow tying device. The upper left tying support and the upper right tying support may be protruding perpendicularly away from the bow tying device. The upper left tying support and the upper right tying support may be in parallel. The lower right tying support and the upper right tying support are extending away from the lower work surface and the upper work surface respectively.

The lower right tying support and the upper right tying support may create a horizontal space in between. The horizontal space in between may align from the left side to the right side of the bow tying device at the junction of the upper work surface and the lower work surface. The left fastener and the right fastener may be angled adjacent to the upper left tying support and the upper right tying support.

The upper left tying support, the upper right tying support, the lower left tying support and the lower right tying support may be coupled to the upper work surface and the lower work surface respectively to allow for at least one vertical space and horizontal space. The main port on the bottom of the bow tying device and the lower left tying support and the lower right tying support may protrude perpendicularly away from the bow tying device. The main port may be a button. The lower left tying support and the lower right tying support may be in parallel.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
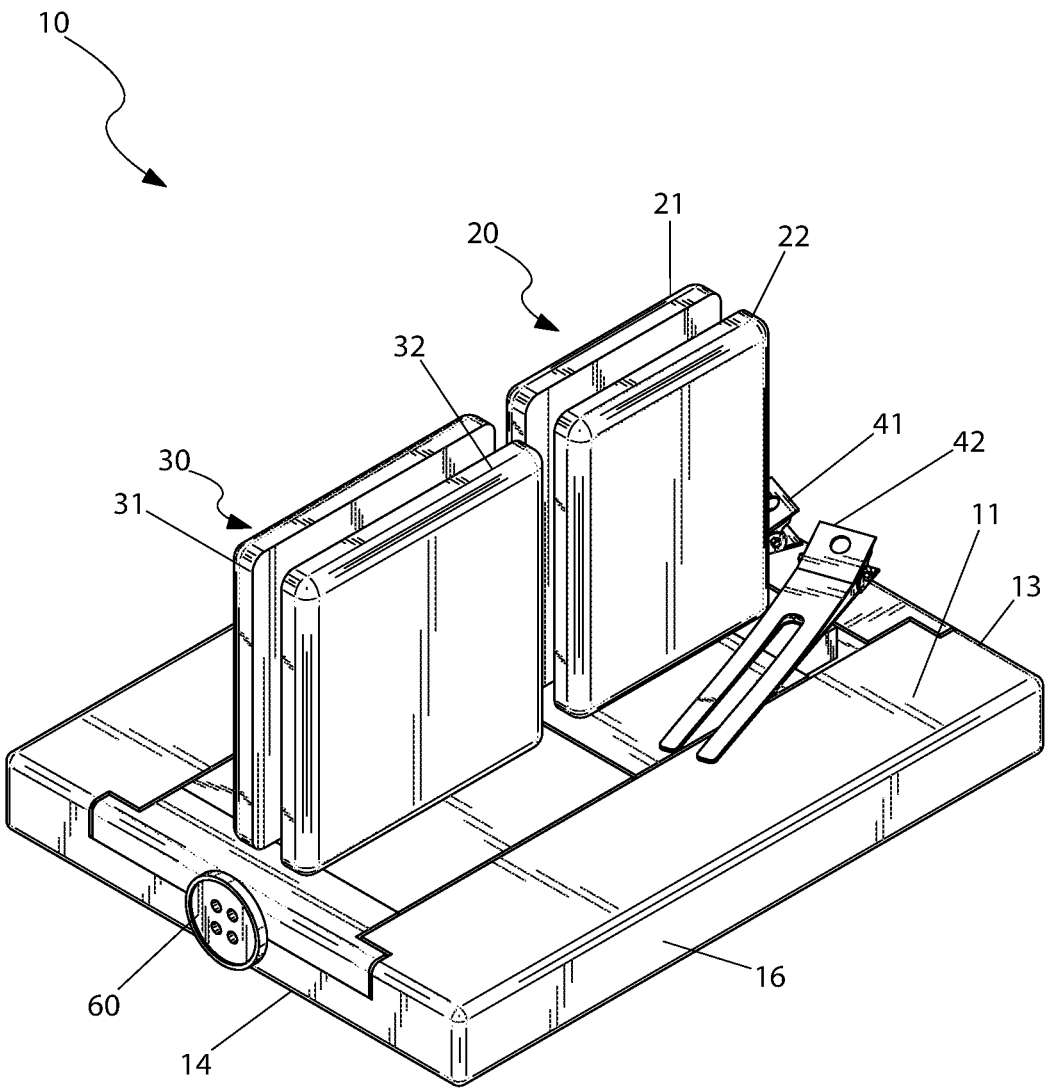
FIG. 1 is a bottom-front perspective view of the bow tying device 10, according to the preferred embodiment of the present invention.

10 bow tying device
11 front
12 back
13 top
14 bottom
15 left side
16 right side
20 upper work surface
21 upper left tying support
22 upper right tying support

30 lower work surface
31 lower left tying support
32 lower right tying support
41 left fastener
42 right fastener
50 inner cavity
60 main port

DESCRIPTION OF THE PREFERRED EMBODIMENTS

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a bottom-front perspective view of the bow tying device 10, according to the preferred embodiment of the present invention is disclosed. The bow tying device 10 (herein also described as the "device"), includes a front 11, a back 12, a top 13, a bottom 14, a left side 15, and a right side 16. The device 10 may also include an upper work surface 20 and a lower work surface 30. The upper work surface 20 may be coupled to an upper left tying support 21, an upper right tying support 22, a left fastener 41 and a right fastener 42. The lower work surface 30 may include a lower left tying support 31, a lower right tying support 32 and a main port 60 along the bottom 14. In use, the left fastener 41 and right fastener 42 may allow a user to manipulate a ribbon (not illustrated) around the upper left tying support 21, upper right tying support 22, lower left tying support 31 and lower right tying support 32.

Figure 2:
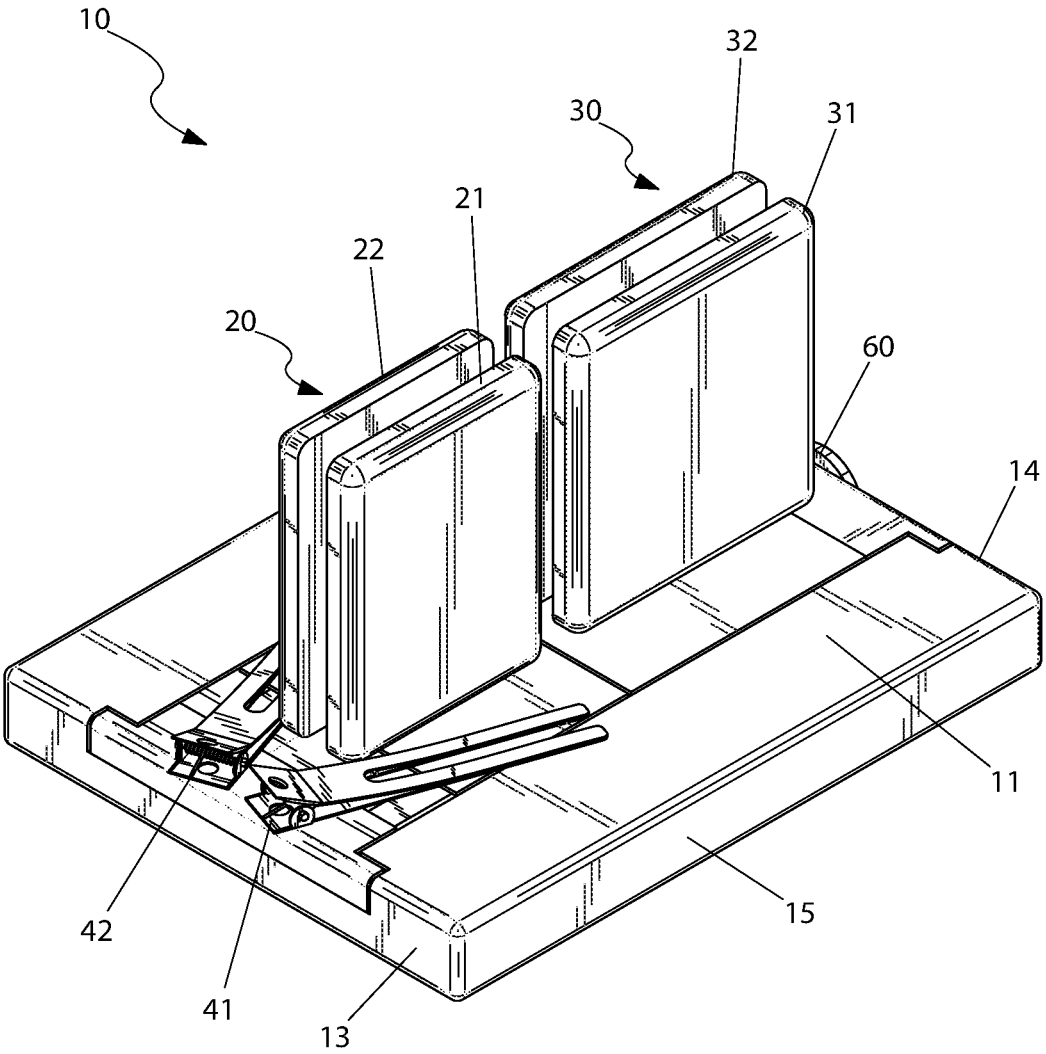
FIG. 2 is a top-front perspective view of the bow tying device 10, according to the preferred embodiment of the present invention.

Referring next to FIG. 2, a top-front perspective view of the bow tying device 10, according to the preferred embodiment of the present invention is depicted. This view illustrates the top 13 of the device 10, with the left fastener 41 and right fastener 42 coupled to the upper work surface 20. As illustrated in FIG. 1, the device 10 includes the upper right tying support 22, upper left tying support 21, lower right tying support 32 and lower left tying support 31 on the front 11 of the device 10. In a closed state, the upper work surface 20 and the lower work surface 30 conceal an inner cavity which may be used to store associated contents within the device 10.

In a preferred embodiment, the upper left tying support 21 and upper right tying support 22 of the upper work surface 20, and the lower left tying support 31 and lower right tying support 32 of the lower work surface 30 each comprises a general rectangular prism with upper corners (i.e., the corners thereof that are not attached to the top 13) are rounded. In an exemplary embodiment, the upper left tying support 21 and upper right tying support 22 are identical in shape. Similarly, the lower left tying support 31 and lower right tying support 32 are identical in shape. The upper work surface in an exemplary embodiment is smaller in overall volume than that of the lower work surface 30.

Figure 3:
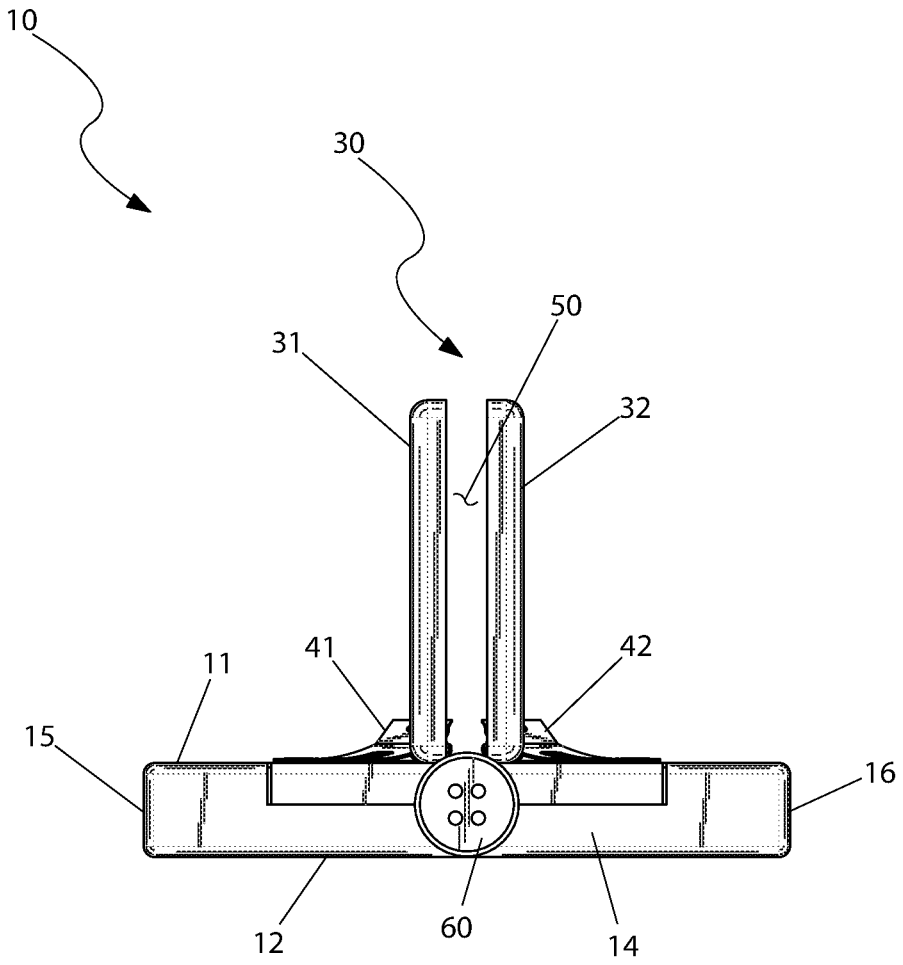
FIG. 3 is a bottom view of the bow tying device 10, illustrating the main port 60 on the bottom 14 of the device 10 and the lower left tying support 31 and the lower right tying support 32 protruding perpendicularly away from the device 10, according to the preferred embodiment of the present invention.

Referring now to FIG. 3, there is shown a bottom view of the bow tying device 10. This view illustrates the main port 60 on the bottom 14 of the device 10 and the lower left tying support 31 and the lower right tying support 32 protruding perpendicularly away from the device 10. The main port 60 is preferably fashioned as a button. The lower left tying support 31 and the lower right tying support 32 may be configured in parallel to allow for a vertical space in between to support a ribbon and/or rubber band supports (not illustrated).

Figure 4:
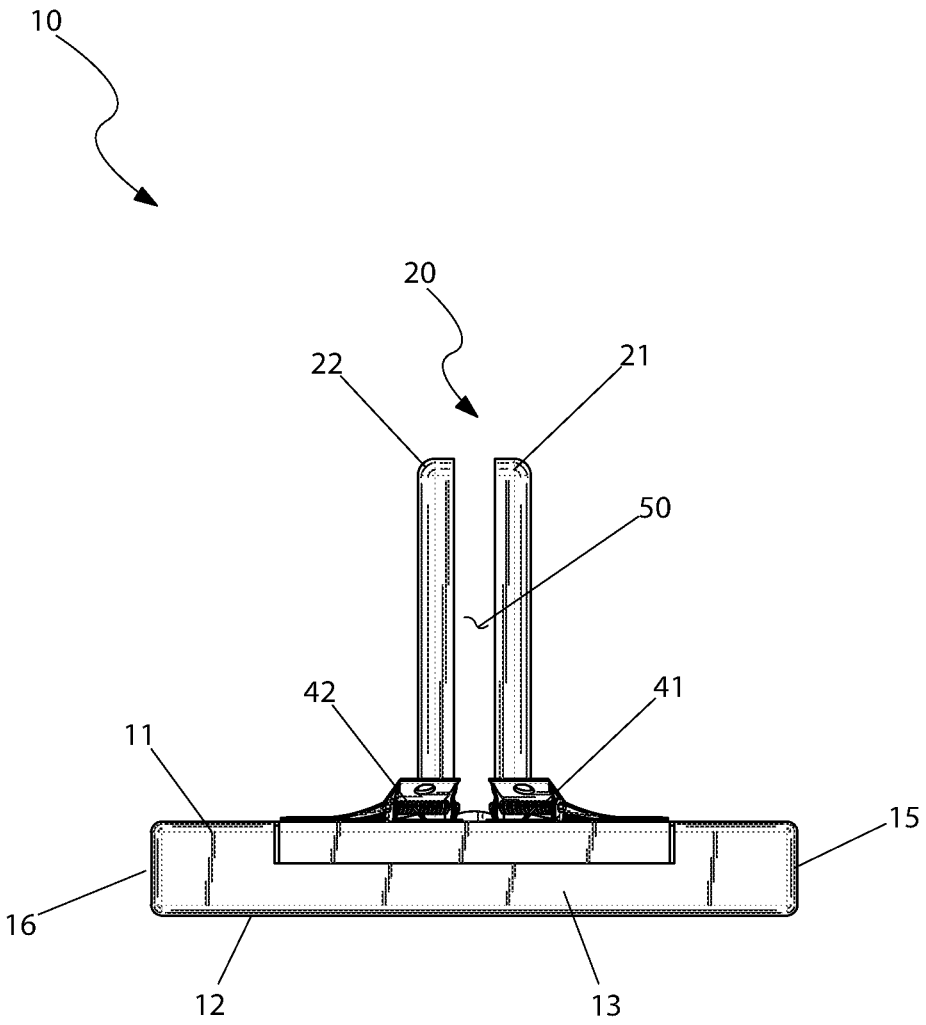
FIG. 4 is a top view of the bow tying device 10, illustrating the left fastener 41 and right fastener 42 on the top 13 of the device 10. Also shown are the upper left tying support 21 and the upper right tying support 22 protruding perpendicularly away from the device 10, according to the preferred embodiment of the present invention.

Referring next to FIG. 4 is a top view of the bow tying device 10. This current view illustrates the left fastener 41 and right fastener 42 on the top 13 of the device 10. Also shown are the upper left tying support 21 and the upper right tying support 22 protruding perpendicularly away from the device 10. Similar to FIG. 3, the upper left tying support 21 and the upper right tying support 22 may be configured in parallel to allow for a vertical space in between to support a ribbon and/or rubber band supports (not illustrated).

Figure 5:
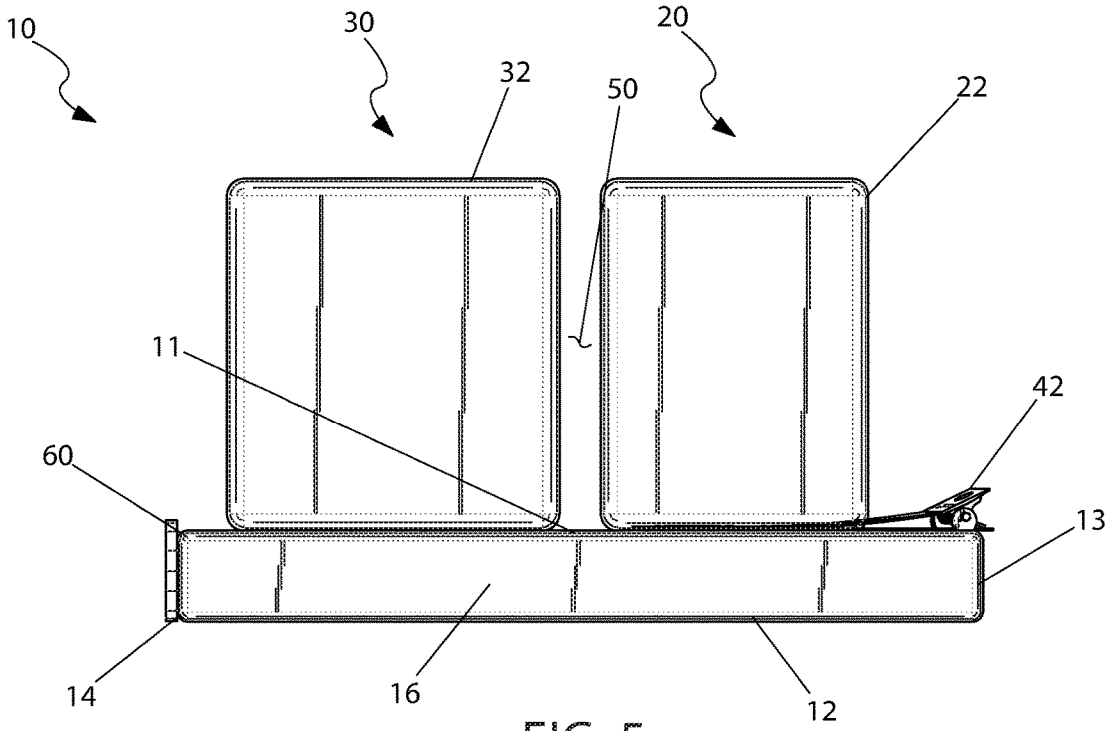
FIG. 5 is a right-side view of the bow tying device 10, showing the lower right tying support 32 and upper right tying support 22 extending away from the lower work surface 30 and upper work surface 20 respectively, according to the preferred embodiment of the present invention.

Referring next to FIG. 5, a right-side view of the bow tying device 10, showing the lower right tying support 32 and upper right tying support 22 extending away from the lower work surface 30 and upper work surface 20 respectively. The lower right tying support 32 and the upper right tying support 22 may be configured as such to create a horizontal space in between. The resulting space may align from the left side 15 to the right side 16 of the device 10 at the junction of the upper work surface 20 and the lower work surface 30.

Figure 6:
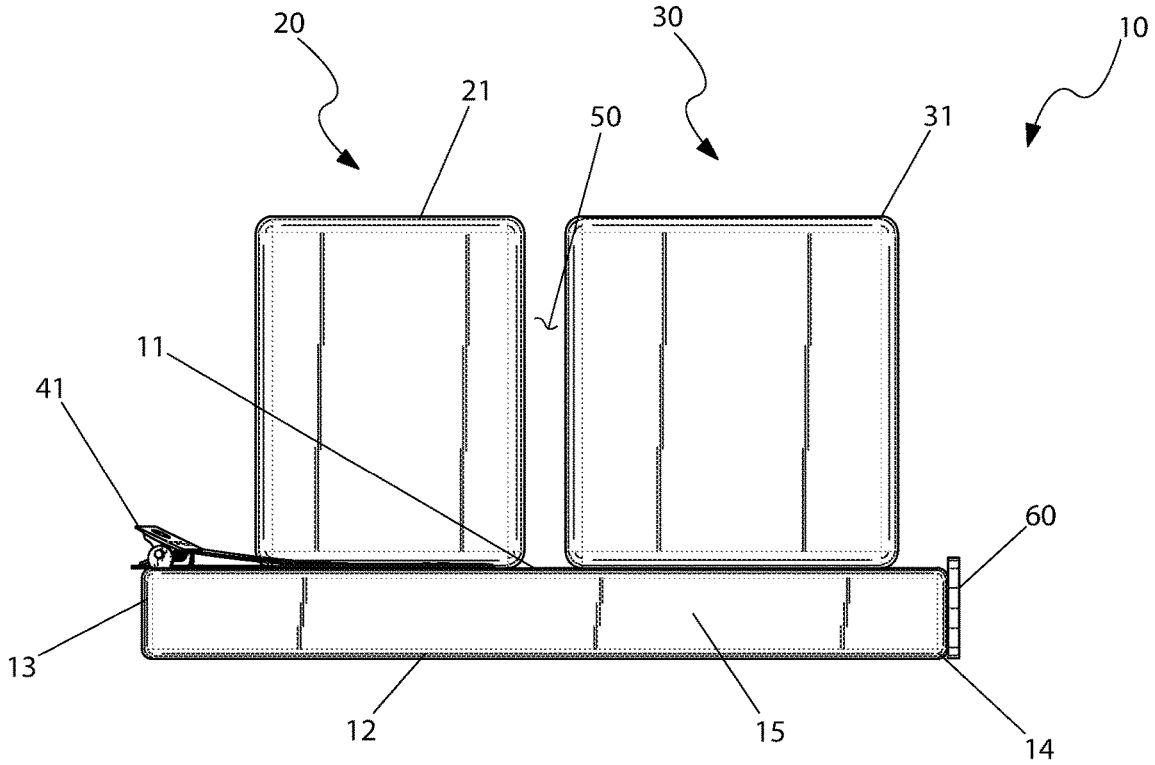
FIG. 6 is a left-side view of the bow tying device 10, showing the lower left tying support 31 and upper left tying support 21 extending away from the lower work surface 30 and upper work surface 20 respectively, according to the preferred embodiment of the present invention.

Referring now to FIG. 6, a left-side view of the bow tying device 10, showing the lower left tying support 31 and upper left tying support 21 extending away from the lower work surface 30 and upper work surface 20 respectively. In similar fashion to components illustrated in FIG. 5, the device 10 configures the lower left tying support 31 and the upper left tying support 21 in a manner to create a horizontal space in between. The resulting space may align from the left side 15 to the right side 16 of the device 10 at the junction of the upper work surface 20 and the lower work surface 30.

Figure 7:
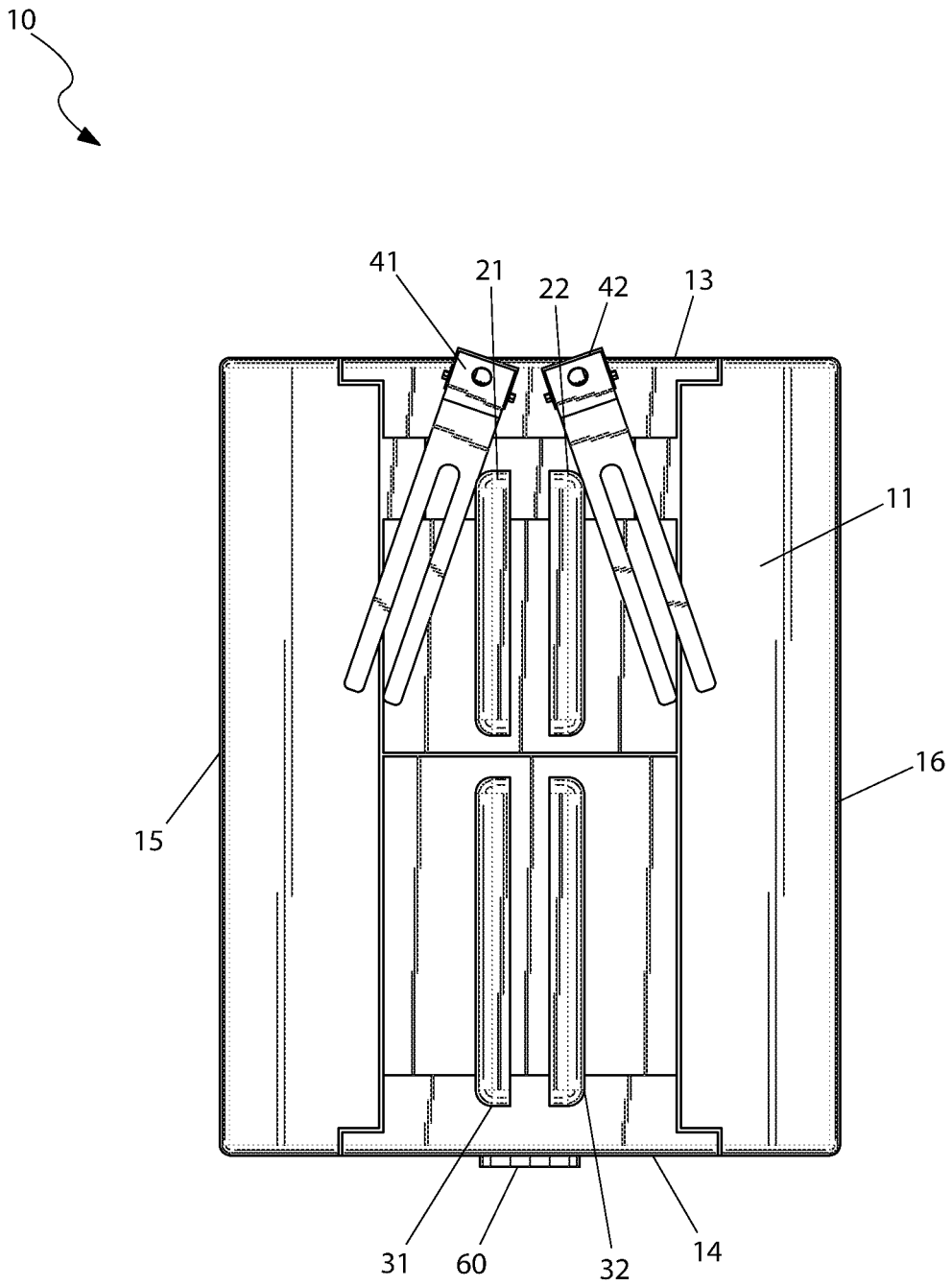
FIG. 7 is a front view of the bow tying device 10, with the left fastener 41 and right fastener 42 angled adjacent to the upper left tying support 21 and upper right tying support 22, according to the preferred embodiment of the present invention; and, FIG. 8 is a back view of the bow tying device 10, according to the preferred embodiment of the present invention.

Referring next to FIG. 7, there is shown a front view of the bow tying device 10, with the left fastener 41 and right fastener 42 angled adjacent to the upper left tying support 21 and upper right tying support 22. Here it is shown that the upper left tying support 21, upper right tying support 22, lower left tying support 31 and lower right tying support 32 are coupled to the upper work surface 20 and lower work surface 30 respectively to allow for at least one (1) vertical space and horizontal space within said components. These spaces may be useful for supporting ribbons of varying sizes so that loops of a bow may be created thereabout.

Figure 8:
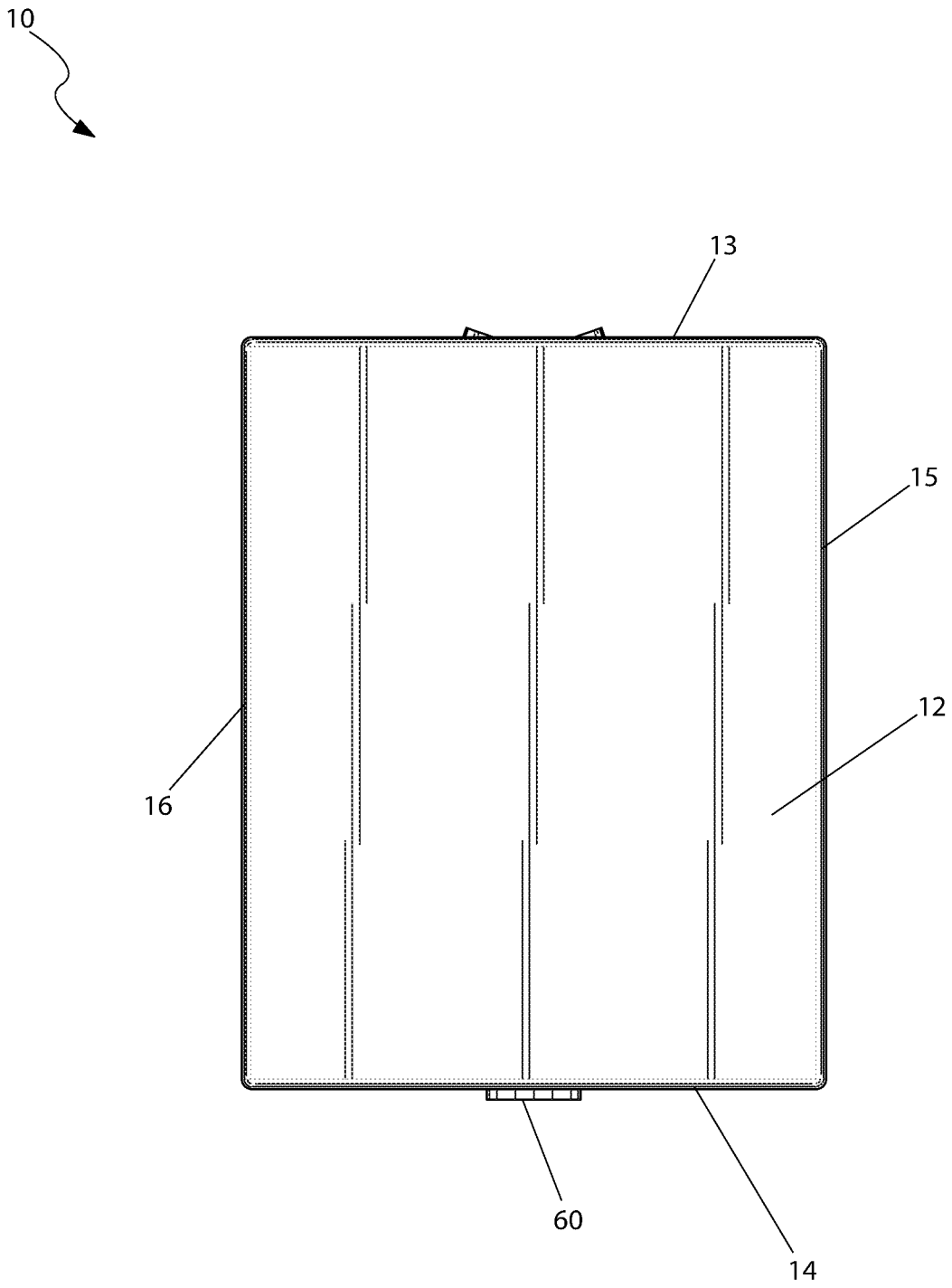

Referring finally to FIG. 8, a back view of the bow tying device 10 is illustrated. This view shows the back 12 of the device 10 with the left fastener 41 and right fastener 42 extending slightly beyond the top 13 of the device 10. On the bottom 14 of the device 10, the main port 60 can also be seen extending slightly past the bottom 14. The back 12 of the device may be substantially planar in configuration to allow for a stable surface from which the device 10 may be placed.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 8. The user would acquire a bow tying device 10 and provide associated supplies in order to create a 3-piece bow. The supplies required may include an elastic band for coupling the bow to an item, a first ribbon to be used as a streamer or as a securing means, and a second ribbon to be looped within the device 10 to create a bow shape.

The construction of the 3-piece bow may be done by placing the first ribbon within the vertical opening between the right tying supports (upper 22 and lower 32) and the left tying supports (upper 21 and lower 31). The elastic band may then be placed within the horizontal space. The first ribbon may then be pulled out from underneath the elastic band. The second ribbon may then be positioned in the horizontal space between the upper and lower supports 21, 22, 31, 32. From here, a series of loops may be formed around the supports 21, 22, 31, 32. Once loops have been formed, the first ribbon may be arranged within the second ribbon and then tied to make a knot. The device 10 may be especially useful for creating easy to use bows from ribbons of different sizes.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A bow tying device, comprising:

a front;

a back;

a top;

a bottom;

a left side; and a right side;

an upper work surface coupled to an upper left tying support, an upper right tying support, a left fastener, and a right fastener; and a lower work surface having a lower left tying support, a lower right tying support and a main port along the bottom, wherein the upper work surface and the lower work surface conceal an inner cavity which is used to store a plurality of associated contents within the bow tying device;

wherein the upper work surface is smaller in overall volume than the lower work surface; and, wherein the left fastener and the right fastener are angled adjacent to the upper left tying support and the upper right tying support.

2. The bow tying device according to claim 1, wherein the left fastener and the right fastener manipulate a ribbon around the upper left tying support, the upper right tying support, the lower left tying support and the lower right tying support.

3. The bow tying device according to claim 1, wherein the left fastener and the right fastener are coupled to the upper work surface.

4. The bow tying device according to claim 1, wherein the upper left tying support and the upper right tying support of the upper work surface, and the lower left tying support and the lower right tying support of the lower work surface each is a general rectangular prism.

5. The bow tying device according to claim 4, wherein the general rectangular prisms each have a plurality of rounded upper corners.

6. The bow tying device according to claim 1, wherein the lower left tying support and the lower right tying support are identical in shape.

7. The bow tying device according to claim 1, wherein the left fastener and the right fastener are on the top of the bow tying device.

8. The bow tying device according to claim 1, wherein the upper left tying support and the upper right tying support are protruding perpendicularly away from the bow tying device.

9. The bow tying device according to claim 1, wherein the upper left tying support and the upper right tying support are in parallel.

10. The bow tying device according to claim 1, wherein the lower right tying support and the upper right tying support are extending away from the lower work surface and the upper work surface respectively.

11. The bow tying device according to claim 1, wherein the lower right tying support and the upper right tying support create a horizontal space in between.

12. The bow tying device according to claim 1, wherein the horizontal space in between aligns from the left side to the right side of the bow tying device at the junction of the upper work surface and the lower work surface.

13. The bow tying device according to claim 1, wherein the upper left tying support, the upper right tying support, the lower left tying support and the lower right tying support are coupled to the upper work surface and the lower work surface respectively to allow for at least one vertical space and horizontal space.

14. The bow tying device according to claim 1, wherein the main port on the bottom of the bow tying device and the lower left tying support and the lower right tying support protrude perpendicularly away from the bow tying device.

15. The bow tying device according to claim 14, wherein the main port is a button.

16. The bow tying device according to claim 1, wherein the lower left tying support and the lower right tying support are in parallel.

* * * * *